United States Patent [19]

Mochida et al.

[11] 3,955,459

[45] May 11, 1976

[54] ELECTRONIC MUSICAL INSTRUMENT

[75] Inventors: Yasunori Mochida; Akinori Endo; Hirokazu Katoh, all of Hamamatsu, Japan

[73] Assignee: Nippon Gakki Seizo Kabushiki Kaisha, Japan

[22] Filed: June 10, 1974

[21] Appl. No.: 477,996

[30] Foreign Application Priority Data

June 12, 1973 Japan ..... 48-65406
June 12, 1973 Japan ..... 48-65407
June 12, 1973 Japan ..... 48-65408

[52] U.S. Cl. ..... 84/1.01; 84/1.03; 84/115

[51] Int. Cl.[2] ..... G10F 5/00; G10H 5/00

[58] Field of Search ..... 84/1.01, 1.03, DIG. 7, 84/DIG. 8, DIG. 23, 115

[56] References Cited

UNITED STATES PATENTS

| | | | |
|---|---|---|---|
| 3,515,792 | 6/1970 | Deutsch | 84/1.03 |
| 3,594,487 | 7/1971 | Jones, Jr. | 84/1.01 X |
| 3,610,799 | 10/1971 | Watson | 84/1.01 |
| 3,683,096 | 8/1972 | Peterson et al. | 84/1.03 X |
| 3,697,661 | 10/1972 | Deutsch | 84/1.01 |
| 3,746,773 | 7/1973 | Uetrecht | 84/1.01 |
| 3,789,719 | 2/1974 | Maillet | 84/1.03 X |
| 3,809,786 | 5/1974 | Deutsch | 84/1.01 |
| 3,821,712 | 6/1974 | Wetzel | 84/1.01 X |
| 3,865,002 | 2/1975 | Shimizu et al. | 84/115 |
| 3,878,750 | 4/1975 | Kapps | 84/1.01 |
| 3,890,871 | 6/1975 | Oberheim | 84/1.01 |

*Primary Examiner*—L. T. Hix
*Assistant Examiner*—Stanley J. Witkowski
*Attorney, Agent, or Firm*—Robert E. Burns; Emmanuel J. Lobato; Bruce L. Adams

[57] ABSTRACT

An automatic performance system in an electronic musical instrument comprises circuits for forming digital performance information signals by converting the displacement of movable members operated according to the contents of a performance into digital signals, and circuits for forming musical tone information signals corresponding to the contents of the performance from harmonic rich tone signals by controlling predetermined signal paths with electronic switches operated in response to the performance information signals, the digital performance information signals being detected and stored, and read out into the electronic switches at proper time instants, whereby all of the performance information signals are automatically reproduced as musical tone information signals with fidelity. The digital performance information can be automatically modified as desired in the process of storage and reproduction thereof to obtain modified musical tone information, and can furthermore be stored as information in a compressed state which contains digital signals indicating the occurrence of events in the performance and relative time information between the events.

4 Claims, 10 Drawing Figures

ELECTRONIC MUSICAL INSTRUMENT

BACKGROUND OF THE INVENTION

This invention relates to automatic performance systems for electronic musical instruments, and more particularly to an automatic performance system for an electronic musical instrument in which performer's operations are stored as digital information signals whereby the digital information signals, or performance information signals, are automatically reproduced with the performance being modified as required.

In general, it is well known in electronic musical instruments, electronic organs for instance, to obtain musical tone signals from harmonic signals containing many high frequency components such as square waves, the electrical circuits being controlled in response to the displacement of movable members such as keys, pedals, levers, push buttons and knobs to generate musical tone information signals or acoustic information signals as desired.

Heretofore, an automatic performance system for an electronic musical instrument has been proposed in which instead of recording acoustic information signals in a tape recorder for instance and reproducing it therefrom, analog performance information signals consisting of harmonic rich tone signals selected by the operations of keys according to the contents of a performance are stored in a proper memory device, and the information signals thus stored are written into the tone coloring circuit or format circuit of the electronic musical instrument thereby to reproduce the performance.

However, in such a conventional automatic performance system for an electronic musical instrument as described above, it is necessary that generated tone signals (analog signals) having a number of harmonic waves which are converted into readily stored signals such as magnetic or optical signals in response to the selective operation of the keys and these signals thus converted are reproduced as the original or initial electrical analog signals. Accordingly, the waveforms of the generated tone signals are liable to be deformed by noises or distortions during the two conversion operations described above, that is, it is difficult to reproduce the performance signals with fidelity. In order to overcome this difficulty, it is necessary to newly modify the circuits including the tone coloring circuit in the following stages, as a result of which the automatic performance system will become more intricate in its construction.

Furthermore, in this conventional automatic performance system, mainly the information on the operation of the keyboard, that is, the information on tonal pitches and tempos is automatically reproduced, but the information on tone color variation, volume variation and effects (vibrato, tremolo and the like) cannot be automatically reproduced, and the movable members such as tone levers and volume knobs must be maintained set at their fixed positions until the reproduction of the information on the keyboard operation mentioned above, or must be readjusted in the reproduction. This is another difficulty accompanying the conventional automatic performance system.

In addition, the conventional automatic performance system necessitates memory devices having a considerably large memory capacity for storing the performance information signals, and it is also difficult to provide proper means suitable for the reduction of the memory capacity.

SUMMARY OF THE INVENTION

Accordingly, it is a primary object of this invention to provide an automatic performance system in an electronic musical instrument which can overcome all of the difficulties described above accompanying a conventional automatic performance system for an electronic musical instrument.

Another object of the invention is to provide an automatic performance system in an electronic musical instrument in which all of the performance information on tone pitches, tempos, colors, volumes, vibrato effect and the like which are obtained from movable members such as a keyboard, tone levers, an expression pedal, and a vibrato switch operated by a performer during a performance can be automatically reproduced with high fidelity and modification as desired.

Still another object of this invention is to provide an automatic performance system in an electronic musical instrument in which the memory capacity of a memory device for storing performance information signals is reduced.

A further object of this invention is to provide an automatic performance system in an electronic musical instrument in which a completely automatic performance reproduction can be achieved even by a non-professional.

Still a further object of the invention is to provide an automatic performance system in an electronic musical instrument in which along with an automatic reproduction, a performer can apply performance information signals which are not automatically reproduced intentionally, to the electronic musical instrument.

A specific object of the invention is to provide a keyboard information detection memory system in an electronic musical instrument in which the memory capacity of a memory device can be reduced and performance information can be stored with fidelity.

A particular object of the invention is to provide a performance information reproduction system in an electronic musical instrument in which keyboard performance information stored can be reproduced with high fidelity and with modification as desired.

The foregoing objects and other objects as well as the characteristic features of this invention will become more apparent from the following detailed description and the appended claims when read in conjunction with the accompanying drawings, in which like parts are designated by like reference numerals or characters.

DETAILED DESCRIPTION OF THE INVENTION

Figure 1:
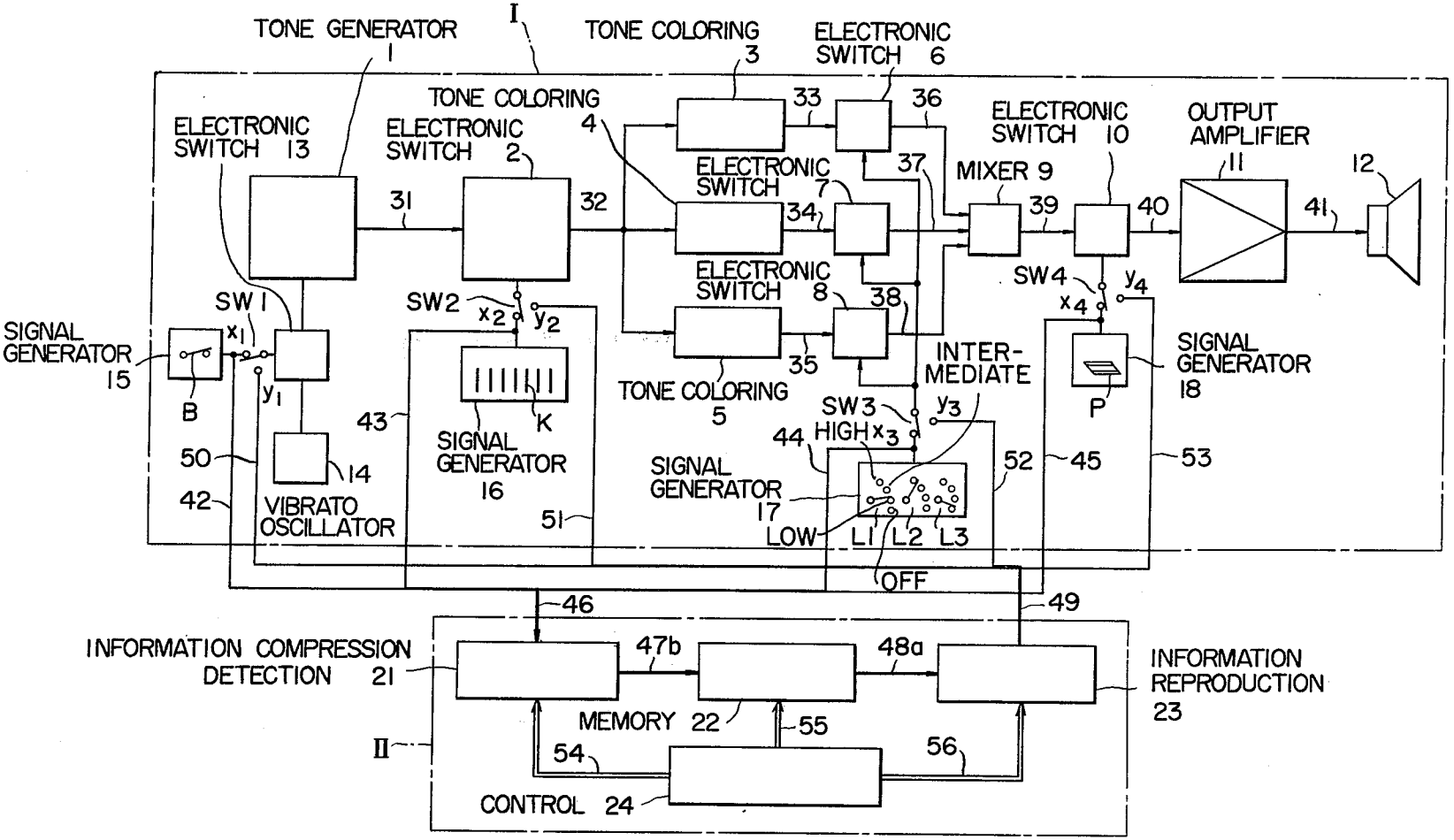
FIG. 1 is a block diagram indicating one example of an automatic performance system in an electronic musical instrument according to this invention.

One example of an automatic performance system in an electronic musical instrument according to this invention is shown in FIG. 1 which comprises: an electronic musical instrument I which operates according to digital performance information corresponding to displacement of movable members, e.g. keys, tone levers, volume control knobs, expression pedals, etc., operated by a performer; and a performance information processing system II which processes the digital performance information received from the electronic musical instrument I and delivers the information thus processed to the electronic musical instrument I.

First, the construction and operation of the electronic musical instrument I will be described. This electronic musical instrument I, as is illustrated in FIG. 1, comprises a tone generator 1 having a plurality of oscillators each generating a harmonic signal containing many harmonic signals (hereinafter referred to as "a harmonic rich tone signal" when applicable) such as a square wave signal and a sawtooth wave signal. A plurality of harmonic rich tone signals 31 from the tone generator 1 are delivered to a keyboard electronic switch 2 which consists of a group of switching elements such as field effect transistors.

A signal generator 16 is connected to the electronic switch 2 through a switch $SW_2$. This signal generator 16 operates to generate digital keyboard signals according to the displacement of key switches K in the keyboard so that the switching elements of the electronic switch 2 are controlled according to the performance information relating to tonal pitches and tempos which are obtained by the operations of the key switches selected according to a musical performance, as a result of which harmonic rich tone signals 32 are produced by the electronic switch 2.

The harmonic rich tone signals 32 thus produced are introduced into tone coloring circuits 3, 4 and 5 each including a tone color filter or a formant filter, where these signals 32 are shaped in accordance with the filtering characteristics of the tone coloring circuits 3, 4 and 5 into musical tone signals 33, 34 and 35 which have frequency spectra of, for instance, flute, string and reed tones, respectively.

The musical tone signals 33, 34 and 35 are applied to electronic switches 6, 7 and 8 provided for tone levers $L_1$, $L_2$, and $L_3$, where these signals are modified into musical tone signals 36, 37 and 38 whose amplitudes are limited between the zero level and the input levels, respectively. The musical tone signals 36, 37 and 38 thus obtained are applied to a mixing circuit 9.

The electronic musical instrument I further comprises a digital tone lever signal generator 17 provided with the tone levers $L_1$, $L_2$ and $L_3$ corresponding to the electronic switches 6, 7 and 8. This digital tone lever signal generator 17 serves to introduce switch controlling digital signals corresponding to the displacement of the tone levers to the electronic switches 6, 7 and 8 through a switch $SW_3$. More specifically, the tone levers can be set at positions between the highest position and the lowest position properly according to a performance. If the tone levers are set, for instance, at the high, intermediate or low position (the tone levers shown in FIG. 1 having four positions: high, intermediate, low and off, the positions for $L_2$ and $L_3$ being the same as those indicated for $L_1$), the musical tone signals 33, 34 and 35 corresponding respectively to flute, string and reed tones can be changed into the musical tone signals 36, 37 and 38 whose amplitudes are defined by the positions of the tone levers, respectively. In this connection, if one of the tone levers is set at the position "zero" or "OFF", the corresponding musical tone signal will not be produced.

The musical tone signals 36, 37 and 38 thus changed are mixed in the mixing circuit 9 to produce a mixing output signal 39. This mixing output signal 39 is delivered to an output amplifier 11 through an electronic switch 10 for an expression pedal P.

The electronic musical instrument I is further provided with a pedal signal generator 18 having the expression pedal P. This pedal signal generator 18 is connected through a switch $SW_4$ to the electronic switch 10 to convert displacement of the pedal P into a digital signal. This electronic switch 10 includes a switching element operating in response to the digital pedal signals, and produces a mixing output signal 40 whose amplitude is controlled according to the digital signal corresponding to the displacement of the pedal. The mixing output signal 40 thus produced is applied to the output amlifier 11 and then converted through a loud speaker 12 into musical tones.

The tone generator 1 is provided with a vibrato oscillator 14 which is connected thereto through an electronic switch 13, in order to obtain a vibrato effect by vibrato-modifying the harmonic rich tone signal, and a signal generator 15 with a push button B which is depressed to have the vibrato effect. Upon depression of the button B, the signal generator 15 produces a digital signal, which controls the operation of the electronic switch 13.

In the example of the electronic musical instrument I described above, the push button switch B for vibrato, the key switches K, the tone levers $L_1$, $L_2$ and $L_3$, and the expression pedal P have been described as the movable membes to be operated by the performer. However, there are electronic musical instruments which have more movable members. It is obvious that the digital performance system described above can be applied to all of the operating members according to the necessity.

The electronic musical instrument I organized as above can convert into musical tones all of the digital performance information signals obtained by operating the movable members, that is, it can develop through the loud speaker 12 the musical tone information signals corresponding to the digital performance information signals relating to tonal pitches, tempos, tone colors, tonal volumes, and various tonal effects.

Accordingly, digital performance control means different from the conventional electronic musical instruments will be described in detail.

Since mechanical switches having two states "on" and "off" can be employed as the push button switch B for vibrato effect and the key switches K, the signal generators 15 and 16 may be so designed that on-off outputs are produced by closed circuits which are switched on and off by the mechanical switches.

As briefly described above, since each of the tone levers $L_1$, $L_2$ and $L_3$ can be set at four different positions, an analog-to-digital converter (hereinafter denoted merely as an A-D converter when applicable) capable of converting an angular displacement of the lever into a digital signal is provided. Similarly, the amount of displacement of the expression pedal P is converted into a digital signal by another A-D converter.

Figure 2A:
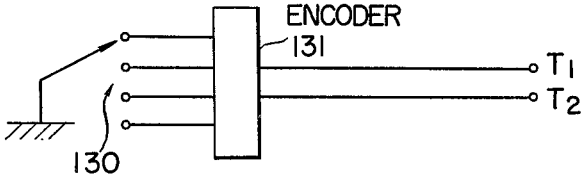
FIGS. 2*a* and 2*b* are schematic diagram illustrating analog-to-digital converters for angular displacement members employed in the example shown in FIG. 1.

One example of the A-D converter for the tone levers is shown in FIG. 2*a* which comprises a rotary switch 130 having four contacts corresponding to the four angular displacement positions of the tone lever, and a 2-bit encoder 131 connected to the rotary switch 130, whereby the four angular displacement conditions of the tone lever are converted into 2-bit binary signals.

Figure 2B:
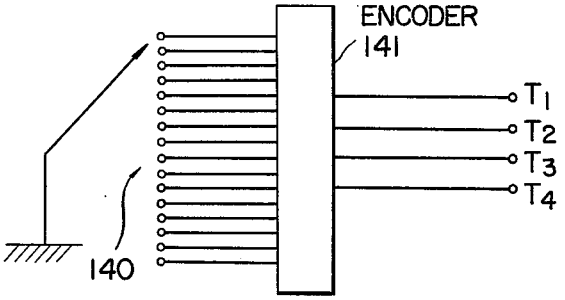

One example of the A-D converter for the expression pedal P is shown in FIG. 2*b* which includes a rotary switch 140 with 16 contacts and a 4-bit encoder 141 connected to the rotary switch 140. In this converter, since an amount of displacement of the expression pedal can be represented by an angular displacement, the full displacement of the pedal consists of sixteen angular displacements corresponding to the sixteen contacts of the rotary switch 140, and these sixteen angular displacements are coverted into 4-bit binary signals.

Figure 3A:
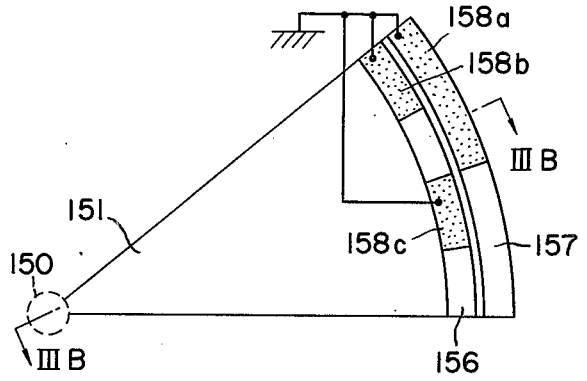
FIG. 3*a* is an explanatory diagrams illustrating a code plate of the analog-to-digital converter shown in FIG. 2*a;*
Figure 3B:
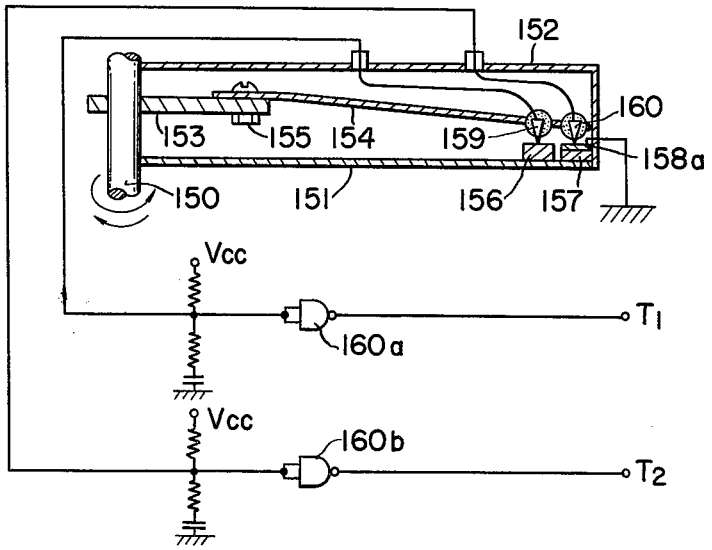
FIG. 3*b* is a sectional view taken along line IIIB—IIIB of FIG. 3*a;*

One example of the A-D converters obtained by combining the rotary switch and the encoder is illustrated in more details in FIGS. 3*a* and 3*b*. The following description is made for the A-D converter (2-bit) for the tone levers; however it will become clear that the A-D converter (4-bit) for the expression pedal can be also constructed in the same manner as in the former A-D converter.

As is apparent from FIGS. 3*a* and 3*b*, a shaft 150 is rotatably provided with respect to a sector-shaped coder plate 151 with a cover 152. This shaft 150 is angularly displaced, or turned, by the tone lever. The A-D converter further comprises a supporting member 153 to which a sliding member 154 is fixed by a set of bolts and nuts 155. The supporting member 153 is fixedly secured to the shaft 150. The sliding member 154 is provided with a pair of contacts 159 and 160 which are electrically insulated from one another and are connected to the input terminals of NAND gates 160*a* and 160*b*, respectively. Between the input terminal of each of the NAND gates and the ground, a series circuit of a resistor and a capacitor are connected in order to prevent chattering.

The A-D converter has two arc-shaped insulating layers 156 and 157 provided concentrically on a surface of the coder plate 151 and grounded metal layers 158*a*, 158*b* and 158*c* provided on the insulating layers as shown in FIG. 3*a*.

In the A-D converter thus organized, a potential $V_{cc}$ is applied through resistors to the input terminals of the NAND gates, and the sliding member 154 is set at four different angular positions by turning the shaft 150 by the use of the tone lever. As a result, 2-bit binary signals (4 states) can be obtained at the output terminals $T_1$ and $T_2$ of the NAND gates in response to the angular positions. Thus, the digital performance information is developed by converting position data from the movable members into digital signals.

The electronic switches 6, 7, and 8, and 10 which are controlled by the output digital signals from the signal generator 17 for the tone levers and the signal generator 18 for the pedal, respectively, will now be described.

Figure 4A:
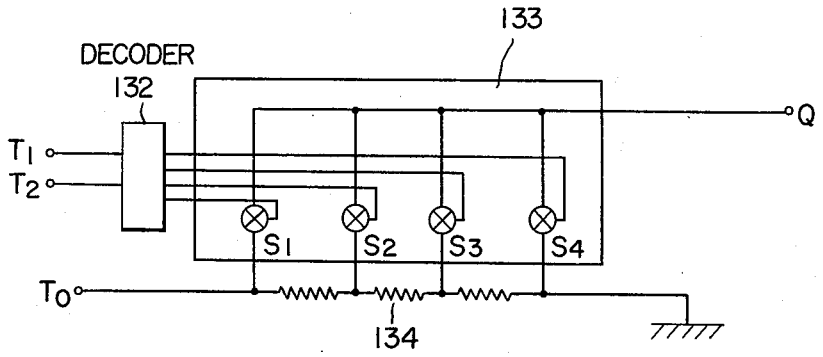
FIGS. 4*a* and 4*b* are schematic circuit diagrams illustrating analog electronic switch circuits employed in the embodiment shown in FIG. 1.
Figure 4B:
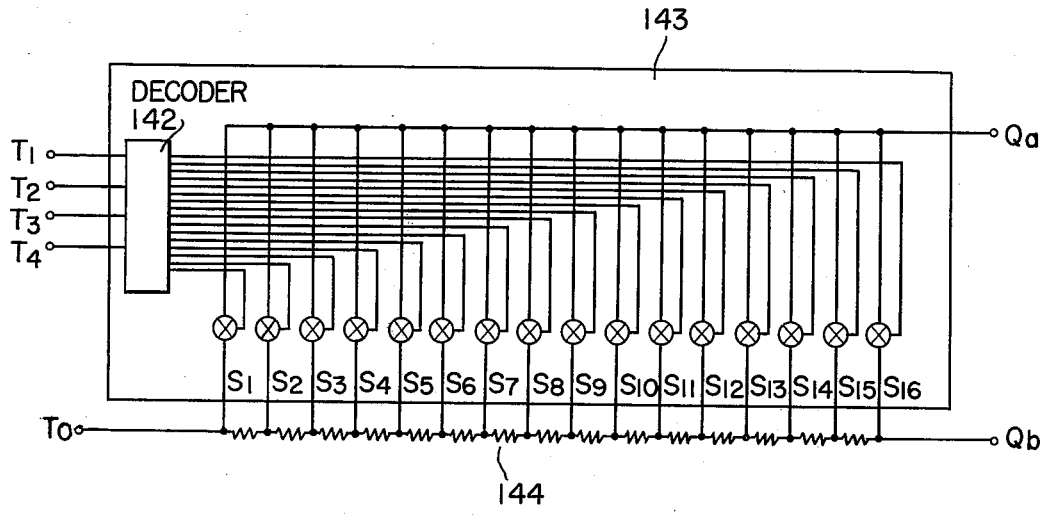

These electronic switches are analog switches which, although they are controlled by the digital signals, operate to deliver their input analog signals to their output terminals according to the control signals and which are such as illustrated in FIGS. 4*a* and 4*b*.

FIG. 4*a* illustrates one example of the electronic switch 6, 7 and 8 which are used in combination with the A-D converter shown in FIG. 2*a*. The circuit shown in FIG. 4*a* comprises solid state switching circuit 133 having switching elements $S_1$, $S_2$, $S_3$ and $S_4$ such as field effect transistors, a voltage dividing resistor network 134 whose taps are connected to the input terminals of the switching circuit 133, and a decoder 132 connected to the input side of the switching circuit 133.

When one of the afore-mentioned musical tone signals 33, 34 and 35 is applied to an input terminal $T_o$ of the switching circuit 133 and a 2-bit binary signal from the A-D converter shown in FIG. 2*a* is applied through the terminals $T_1$ and $T_2$ to the decoder 132, one of the switching elements $S_1$ through $S_4$ is rendered ON. As a result, the musical tone signal 36, 37 or 38 whose amplitude is varied to one of four different magnitudes between the input level and the zero level, and is provided at the output terminal Q of the electronic switch.

FIG. 4*b* shows a circuit of a 4-bit analog electronic switch which is used in combination with the A-D converter shown in FIG. 2*b*. This circuit comprises a solid state switching circuit 143 having switching elements $S_1$ through $S_{16}$ which are controlled by the output of a 4-bit decoder 142, and a voltage dividing resistor network 144 in which a musical tone signal flows thereby to provide partial voltage outputs at its taps. The voltage outputs thus provided are selectively introduced into the circuit 143 in response to a 4-bit binary signal applied to the input terminals $T_1$ through $T_4$ of the decoder 142. That is, the function of the circuit shown in FIG. 4*b* is similar to that of the circuit shown in FIG. 4*a*. Referring back to FIG. 1, the switches $SW_1$ through $SW_4$ are to switch an actual musical performance played by a performer on the electronic musical instrument I over to an automatic musical performance controlled by the information processing system II and vice versa. The movable contacts of these switches are arranged to move simultaneously. However, the simultaneous movement of the switches is not always necessary in the case where the above-mentioned automatic musical performance system is used as a musical lesson system described later.

When the movable contacts of the switches $SW_1$ through $SW_4$ are maintained in contact with their contacts $x_1$ through $x_4$, respectively, digital performance information signals are obtained at the contacts $x_1$ through $x_4$ by operating the movable members of the electronic musical instrument I, namely, the key switches K of the keyboard, the tone levers $L_1$ - $L_3$, the expression pedal P, and the vibrato switch B according to a performance, and musical tones, or acoustic information, is obtained through the loudspeaker according to the digital performance information signals thus obtained.

The construction and operation of the performance information processing system II will now be described with reference to FIG. 1.

The digital signals 42, 43, 44 and 45 obtained at the contacts $x_1$, $x_2$, $x_3$ and $x_4$, respectively, form a digital performance information signal 46, which is introduced to an information compression detection device 21. As a result, the device 21 produces a digital performance information signal 47*b*, in a compressed state, containing a digital signal representing events caused in the performance and a relative time signal indicating a relative time between the events. The digital performance information signal 47*b* thus produced is stored in a memory device 22. The contents of the memory device 22 is read out as a digital information signal 48 into an information reproduction device 23 where the digital information signal 48 is reproduced as a performance information signal 49 in the original state, or in a non-compressed state, and distributed to contacts $y_1$, $y_2$, $y_3$ and $y_4$ of the switches $SW_1$ through $SW_4$.

The performance information processing system II further comprises a control device 24 which produces control signals 54, 55 and 56 to control the operations of the devices 21, 22 and 23. The control signals 54, 55 and 56 are represented by thick arrows to indicate that they each may comprise a plurality of signals.

As is clear from the above description, although the information compression detection device 21 and the information reproduction device 23 are provided in the system II, it is not the function of the memory device 22 to directly store and reproduce the digital performance information signal from the musical instrument I, in order to store a large amount of digital performance information in a memory device which is as small in storage capacity as possible.

By the use of the performance information processing system II in combination with the electronic musical instrument I, an unmanned, or automatic, performance can be carried out as follows. First, the movable contacts of the switches $SW_1$ through $SW_4$ are maintained in contact with the contacts $x_1$ through $x_4$, respectively, so that the information on the performance is stored as the digital performance information signal in a compressed state in the memory device 22. After the completion of the performance, the movable contacts of the switches $SW_1$ through $SW_4$ are thrown over to the contacts $y_1$ through $y_4$ so that the digital performance information signal 48 is read from the memory device 22, reproduced and distributed to the contacts $y_1$ through $y_4$ by means of the information reproduction device 23. As a result, the unmanned, automatic performance of the electronic musical instrument I can be achieved.

In this connection, if the switches $SW_1$, $SW_3$ and $SW_4$ are thrown to the respective contacts $y_1$, $y_3$ and $y_4$ with the switch $SW_2$ being maintained in contact with the contact $x_2$, only the performance information on vibrato effect, tone (tone color) control, and expression control is automatically reproduced, and a keyboard performance can be carried out manually by the performer.

Figure 5:
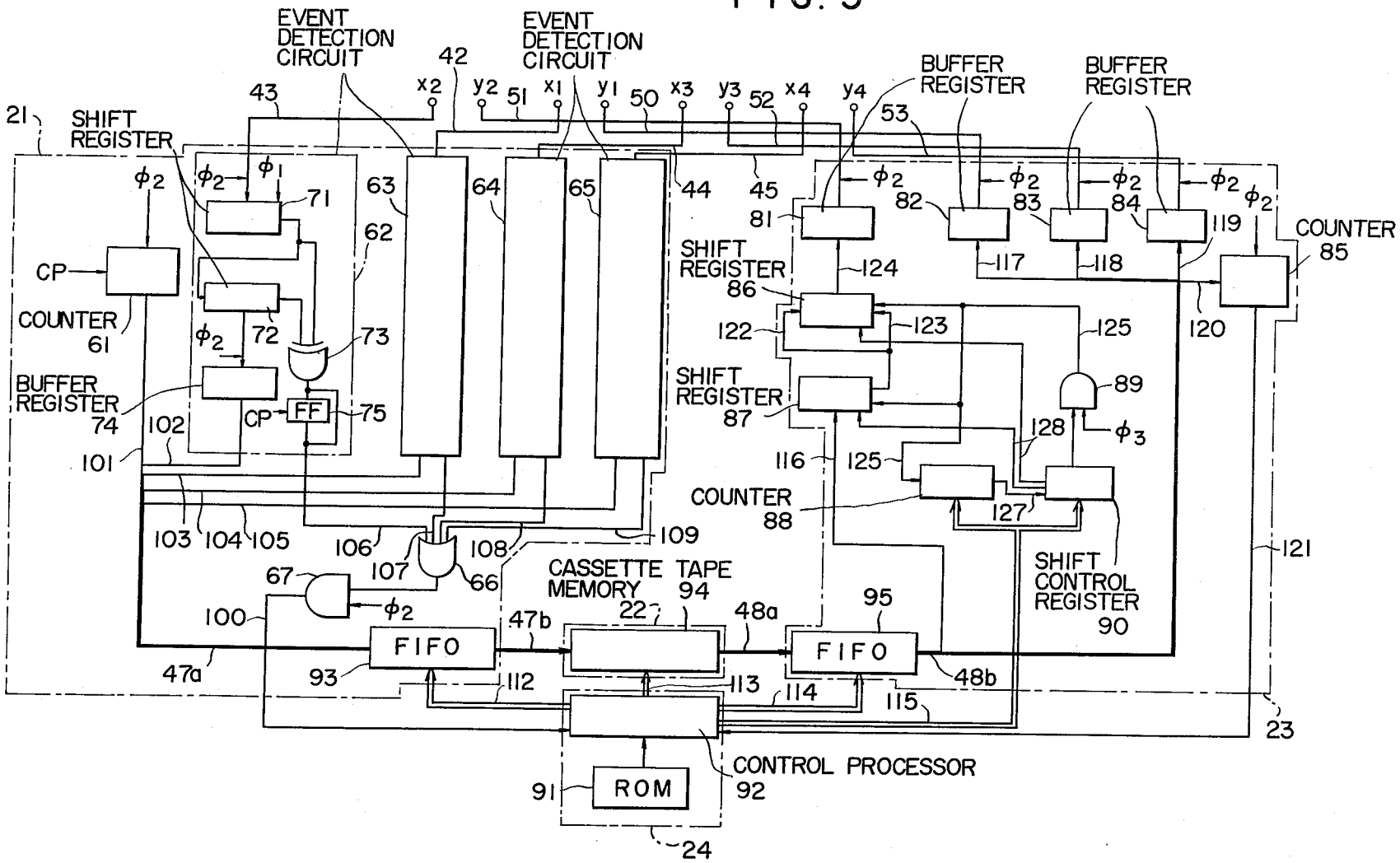
FIG. 5 is a block diagram illustrating a performance information processing system in detail shown in the automatic performance system in FIG. 1.
Figure 6A:
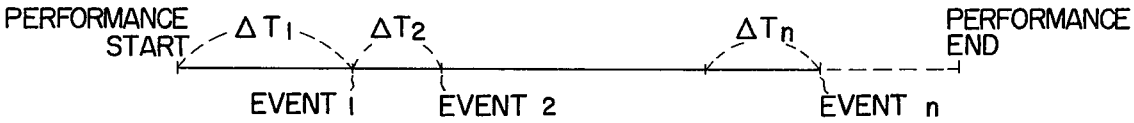
FIG. 6*a* is a timing chart indicating the relationship between events and the relative time of occurrence of the events during a performance.
Figure 6B:
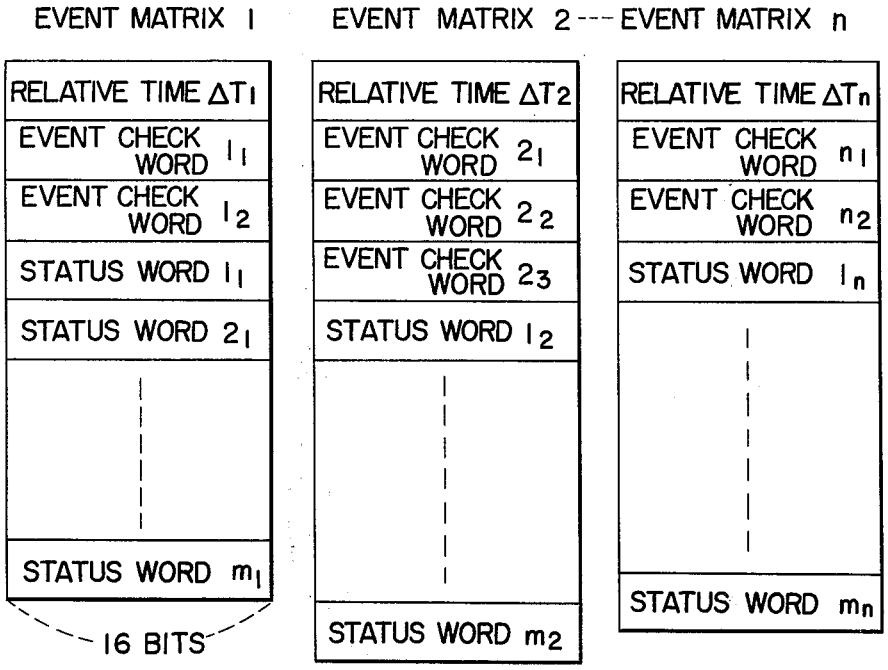
FIG. 6*b* is a diagram illustrating the data format of data stored in a buffer memory.

A concrete circuit of the performance information processing system II is shown in FIG. 5. In this circuit, the above-described contacts $x_1$ through $x_4$ are connected to event detection circuits 62, 63, 64 and 65 as indicated in FIG. 5, each of which is to digitally detect the occurrence of events in the performance played or caused by its corresponding movable members. The events detected are changes in the settings of the movable members which would result in a change in the output of the electronic musical instrument I.

As a typical example of the event detection circuits, the event detection circuit 62 will be described. As was described previously referring to FIG. 1, the digital signals 43 are produced by the keyboard signal generator 16 in response to the displacement of the key switches K. The digital signals 43 thus produced are successively written into a shift register 71 with the aid of clock pulses $\phi_2$ for every period of $T\phi_2 = 1/f\phi_2$. The digital signals thus written are transferred, in order, into a shift register 72 with the aid of a clock pulse $\phi_1$ with a period of $T\phi_1 = T\phi_2/n$ (where, $n = 4$ for instance). At the same time as this transfer, the contents of the shift register 72 are written into a buffer register 74 with the aid of the clock pulse $\phi_2$.

A digital signal indicating the key performance condition or setting which is written into the shift register 71 at the succeeding period of the clock pulse $\phi_2$ is compared by an exclusive OR gate 73 with the digital signal indicating the key performance condition which was written into the shift register 71 at the preceding period, that is, the contents of the shift register 72 for every bit thereof. If non-coincidence occurs for even one bit in this comparison, an output is produced by the exclusive OR gate. This output is temporarily stored in a flip-flop 75. In other words, if the digital signals compared with each other by the exclusive OR gate are not coincident with each other for even one bit, it means the fact that events are caused in the performance, or on-off operations are caused with the key switches.

The output and input terminals of the flip-flop 75 are connected to each other to form a feedback circuit. Therefore, even if only one bit is an event bit in the comparison result of the exclusive OR gate 73, the contents of the flip-flop will become the event bit finally. For instance, if it is assumed for simplification in description that digital signals of sixteen bits are subjected to comparison in the exclusive OR gate with the result of "0001000000000000", the contents of the flip-flop will be "0001111111111111" and finally "1" will be stored therein. For instance, in the case where each of the shift registers 71 and 72 are so designed as to store keyboard performance information signals of 160 bits, the comparison in the exclusive OR gate 73 and the temporary storage in the flip-flop 75 are carried out for every 16 bits and a detection result for every 16 bits, i.e. an event check word, may be temporarily stored in a shift register (not shown). At any rate, the contents of the flip-flop is introduced to an OR gate 66.

As is apparent from FIG. 5, not only the event output from the event detection circuit 62 but also the event outputs from the event detection circuits 63, 64 and 65 are applied to the OR gate 66. The event detectors 63, 64 and 65 are provided for the vibrato switch, the tone levers, and the expression pedal, respectively, to carry out their detection operations in parallel with that of the event detection circuit 62 provided for the keyboard. The result of the OR logic is produced, as a memory request signal, or a request store signal 100, from an AND gate 67 in synchronization with the clock pulse $\phi_2$. The clock pulses $\phi_2$ are counted by a counter 16 which produces an event relative time signal 101 indicating a relative time described in detail later. The relative time of an event is the time interval between a preceeding event and that event, measured in terms of a unit interval $\Delta T$.

The performance information processing system II shown in FIG. 5 further comprises a control processor 92 receiving the request store signal 100. This control processor 92, upon reception of the request store signal 100, operates to cause a first-in first-out memory 93 to store the event relative time signal 101 from the counter 61 and the contents necessary for the operation of the system II out of the contents 102, 103, 104 and 105 of the buffer register 74 and the other event detection circuits 63, 64, and 65, that is, a word corresponding to the bit containing "1" in the register in which the detection result for every 16 bits is stored, in accordance with a command signal 112 from a read-only memory 91 where an information processing sequence or command is stored. Whenever the storing operation in the first-in first-out memory 93 is completed, the counter 61 and the flip-flop 75 are cleared by clear pulses CP. Thus, one cyclic check is completed, and the detection memory operation described above is repeated during the whole performance. The first-in first-out memory 93 is a temporary memory device in which information signals are successively delivered out starting with the information first received, that is, first received information signal is first processed. The control processor 92 provides command signals 112 and 113 to control the memories 93 and 94 so that whenever the contents of the first-in first-out memory 93 reaches a predetermined quantity, an information signal **47*b* is transferred periodically to the cassette tape memory 94 from the memory 93.**

Thus, all of the performance information signals are stored in the cassette tape of the cassette tape memory 94 in the form of a compressed event matrix which includes the digital signals indicating the presence of events when caused and the relative time signals indicating the relative time between the events. In this connection, the provision of the first-in first-out memory 93 is considerably advantageous for storing non-periodic performance information signals in a compressed state in the simple memory 94 which can store information signals for a long time. The first-in first-out memory 93 (and 95 mentioned later) are commercially available. For example, the Texas Instrument first-in first-out serial memory no. 3341 is suitable for use in the present invention. Furthermore, it can be understood that it is also considerably advantageous in reducing the storage capacity of the memories 93 and 94 to store such a great many performance information signals in a compressed state. For instance, in an automatic performance system in which all of the performance information is indicated by 512-bit binary signals, the number of bits which will be changed in a performance is no more than several tens of bits. If this is taken into account, the compression detection memory system described above contributes greatly to the reduction of the storage capacity, and accordingly to the simplification and economization of the whole system.

The construction and operation of a performance information reproduction system where the digital performance information signals are reproduced will now be described.

In the cassette tape memory 94, the digital performance information signals, as shown in FIGS. **6*a* and 6*b*, are stored in the form of event matrixes $1 - n$ which contain event relative times $\Delta T_1 - \Delta T_n$, event check words indicating addresses of buffer registers which undergo events, and status words indicating the contents of buffer registers when events occur and are representative of the settings of respective ones of the movable members corresponding to the event check words. These event matrix information signals 48*a* are sequentially and periodically written into a first-in first-out memory 95. This write operation is controlled by the command signals 113 and 114 from the control processor 92. The control processor 92** may be a commercially available microprocessor such as the Intel 8080.

In the performance information reproduction system, performance information signals 116 on tonal pitches from the keyboard are written into a shift register 87, information signals 117 on the presence and absence of vibrato effect into a buffer register 82, information signals 118 on tone colors relating to the tone levers into a buffer register 83, information signals 119 on tone volumes relating to the expression pedal to a buffer register 84, and event relative time information signals 120 into a counter 85.

The control processor 92 reads out the command signals from the memory 91 thereby to produce the command signals 113, 114 and 115, which control the memories 94 and 95, a counter 88, and a shift control register 90. The command signals 113–115 are represented by thick arrows to indicate that they each may be comprised of a plurality of signals.

A shift register 86 is provided for automatic modulation modification, and a buffer register 81 connected to this shift register 86 is to carry out buffer action when the keyboard information signals are transferred to the electronic musical instrument. Clock pulses $\phi_3$ are supplied to an AND gate 89; however, the supply of the clock pulses is controlled according to the command signal written into the shift control register 90, and the output signal of the AND gate 89 is applied, as a shift control signal, to the shift registers 86 and 87 and is counted by a counter 88. The counter 88 operates to clear the register 90 with its ripple clock signal.

The operation of reproducing the performance information will be described.

First, the signal of event relative time $\Delta T_1$ is read out into the counter 85 and is counted down with the aid of the clock pulses $\phi_2$. The underflow signal of this counter 85 is applied, as an information request signal, namely, a request data signal 121, to the control processor 92.

In response to this signal 121, the control processor 92 checks the contents of an event matrix beginning with the address indicated by an event check word, and instructs the memory 95 to write status words into the shift register 87, address and the buffer registers 82, 83 and 84 which have the corresponding addresses. Similarly as in the case described above, the counter 85 carries out the count down operation with respect to the event relative time $\Delta T_2$. The counter 85 further operates so that the contents of the register 87, 82, 83 and 84 in which the above-described write operations have been completed are maintained until the contents of the counter becomes zero.

Thus, the counter counts the event relative times thereby to detect the events, and the status wounds including the event bits corresponding to the events are read out thereby to reproduce the information relating to tone pitches, tone colors, tone volumes, effects and tempos.

The shift registers 86 and 87 described above have four operation modes, that is, clock inhibit, shift right, shift left, and parallel load. These operation modes are controlled independently by a signal 128 produced by the shift control register 90.

The operation of transferring the keyboard information signals 124 to the buffer register 81 will be described in order.

(1) The shift registers 86 and 87 are set in the parallel load mode, (2) a status word as predetermined information is written in the shift register 83, and (3) the number of bits transferred, that is, bit numbers in the shift registers 86 and 87 are written into the counter 88, and the shift registers 86 and 87 are set in the shift right mode by the shift control register 90 so that the reproduction of the performance information signals is required, in addition to the operation described above, (4) a predetermined shift number (an extent of the modulation) is written in the counter 88, and (5) the shift register 86 is set in the shift right mode or the shift left mode according to a predetermined moduration direction so as to operate counter 88.

If a reverse modulation is necessary, the shift register 87 is set in the shift right mode while the shift register 86 is set in the shift left mode in the operation (3) the counter 88 can be counted down. In this operation, when the transfer is completed and the contents of the counter 88 becomes zero, a ripple clock signal 127 is produced by the counter 88. This ripple clock signal 127 clears the shift register 90, whereby the operations of the counter 88 and the shift registers 86 and 87 are suspended.

The operation described above relates to the fidelity reproduction of the performance information signals. In the case of the modulation modification described above, and the same operations follow.

When a modification reproduction by changing the tempo of the music is necessary, it can be achieved by manually controlling the frequency of the clock pulse $\phi_2$ applied to the counter 85 which frequency has been rendered to be variable. Alternatively, the modification reproduction can be also achieved by writing through the control processor 92 into the counter 85 the value of $\Delta T' = \alpha \Delta T$ which is the product of an event relative time $\Delta T$ and an optional constant $\alpha$. Thus, the information on pitches and tempos is read out and written into the buffer register 81.

On the other hand, the information signals on tonal volumes, colors and effects are written into the buffer registers 82, 83 and 84 at every timing of the events indicated by the relative time signals, respectively.

Finally, the digital performance information signals from the operating members of the electronic musical instrument are respectively reproduced in the buffer registers 81, 82, 83 and 84. Therefore, when the contents of these registers are periodically distributed to the respective contacts $y_1$, $y_2$, $y_3$ and $y_4$ with the aid of the clock pulses $\phi_2$, the musical tone information signals corresponding to the stored performance information signals can be reproduced through the electronic musical instrument.

In the embodiment described above, the memory 94 may be, of course, replaced with the well-known memory device utilizing disks, a semiconductor memory, a magnetic tape or an optical card. Furthermore, the logical circuits in the performance information processing system II described above are not limitative and may be replaced by various circuits obtained by Boolean algebra transformations. In addition, the well-known computer can be employed as the performance information processing system II without departing from the spirit of this invention.

As is apparent from the above description, the automatic performance system in the electronic musical instrument according to this invention can provide the following significant effects:

1. Since the automatic performance system is so arranged that digital performance information signals corresponding to the displacement of the operating members are detected, stored and reproduced, the performance reproduction can be achieved with high fidelity and can be properly modified as desired.
2. A great number of performance information signals are processed in a digital process mode, whereby the storage capacity of the memory device for the performance information can be reduced.
3. The digital performance information signals are obtained from all of the movable members, as a result of which the reproduction of the musical performance can be achieved without bothering the performer, that is, a completely automatic performance can be reproduced with the electronic musical instrument even by a nonprofessional.
4. In reproduction, the reproduction operation can be set so that, for instance, only the information signals as to the keyboard operation are reproduced while the information on tonal volumes, color and effects is not reproduced, or vice versa. Accordingly, along with automatic reproduction, the performer can apply the performance information signals which are not automatically reproduced to the electronic musical instrument. This contributes considerably to the practices of performances, compositions and arrangements.

The automatic performance system according to this invention having the effects described above can be effectively applied, for instance, to an unmanned performance demonstration, a simulation, and a performance lesson system of an electronic musical instrument.

While the principles of this invention have been described above in connection with the automatic performance system of the electronic musical instrument, it is to be clearly understood that this invention can be also applied to the ordinary keyboard instruments in which keyboard information can be processed in a digital mode.

We claim:

1. In an electronic musical instrument of the type having a plurality of manually operable members including keys, control knobs, pedals and the like for controlling the musical instrument output; and means for developing digital signals representative of the settings of said manually operable members; an automatic system for developing, in a compressed format, the sequence of said digital signals developed during use of the electronic musical instrument comprising:

a. means receptive of and responsive to said digital signals for developing event signals corresponding to changes in the settings of ones of said plurality of manually operable members;

b. a counter for developing relative time digital signals representative of the time interval between successive ones of the event signals representative of changes in the setting of a corresponding one of said plurality of manually operable members; and c. a first-in/first-out memory for sequentially storing said event signals and the corresponding relative time digital signals, and for reading-out the stored event signals and the stored corresponding relative time digital signals at intervals less than the intervals represented by said event signals, thereby to develop a compressed sequence of signals representative of a sequence of settings of said manually operable members.

2. In an electronic musical instrument according to claim 1, wherein said means for developing event signals includes at least one event detection circuit comprising:

a. a first register for receiving said digital signals;

b. a second register for receiving the digital signal stored in said first register; and c. a coincidence testing circuit for determining if the digital signals stored in said first and second registers coincide and for developing an event signal if the stored digital signals do not coincide.

3. A performance signal reproduction system comprising:

a. a plurality of registers for storing therein event signals comprised of digital signals representative of changes in the settings of manually operable members of an electronic musical instrument;

b. control means responsive to an input signal comprised of a sequence of event signals and relative time digital signals representative of the time intervals between successive ones of the event signals for applying said input signal to said plurality of registers for storing said event signals in corresponding ones of said registers; and c. a counter receptive of the relative time digital signals for enabling said control means to apply event signals to ones of said plurality of registers after the time interval represented by the relative time digital signals corresponding to the event signals stored in said ones of said plurality of registers has elapsed.

4. In a performance signal reproduction system according to claim 3, further comprising a first-in/first-out buffer memory receptive of said input signal for storing the same, and cooperative with said control means for reading-out the stored event signals and applying the same to said registers under control of said control means.

* * * * *